US008025613B1

(12) United States Patent
Wang

(10) Patent No.: US 8,025,613 B1
(45) Date of Patent: Sep. 27, 2011

(54) ADJUSTABLE DUMBBELL

(75) Inventor: Lo Pin Wang, Taichung (TW)

(73) Assignee: Beto Engineering & Marketing Co., Ltd., Beitun, Taichung (TW)

( * ) Notice: Subject to any disclaimer, the term of this patent is extended or adjusted under 35 U.S.C. 154(b) by 0 days.

(21) Appl. No.: 12/924,334

(22) Filed: Sep. 24, 2010

(51) Int. Cl.
*A63B 21/075* (2006.01)

(52) U.S. Cl. ..... 482/107; 482/108

(58) Field of Classification Search ..... 482/92–94, 482/98–99, 104, 106–109, 908, 909
See application file for complete search history.

(56) References Cited

U.S. PATENT DOCUMENTS

| | | | | |
|---|---|---|---|---|
| 6,669,606 | B2 | 12/2003 | Krull | |
| 6,719,674 | B2 | 4/2004 | Krull | |
| 6,749,547 | B2 * | 6/2004 | Krull | 482/106 |
| 7,077,791 | B2 * | 7/2006 | Krull | 482/108 |
| 7,128,696 | B1 * | 10/2006 | Krull | 482/107 |
| 7,137,931 | B2 | 11/2006 | Liu | |
| 7,153,243 | B1 * | 12/2006 | Krull | 482/107 |
| 7,172,536 | B2 | 2/2007 | Liu | |
| 7,261,678 | B2 * | 8/2007 | Crawford et al. | 482/107 |
| 7,387,597 | B2 * | 6/2008 | Krull | 482/108 |
| 7,534,199 | B2 * | 5/2009 | Krull | 482/108 |
| 7,614,982 | B2 * | 11/2009 | Crawford et al. | 482/107 |
| 7,648,448 | B2 * | 1/2010 | Krull | 482/108 |
| 2003/0114276 | A1 | 6/2003 | Schiff | |
| 2004/0072661 | A1 | 4/2004 | Krull | |
| 2009/0186748 | A1 * | 7/2009 | Golesh et al. | 482/107 |

* cited by examiner

*Primary Examiner* — Loan Thanh
*Assistant Examiner* — Daniel Roland
(74) *Attorney, Agent, or Firm* — Charles E. Baxley

(57) ABSTRACT

An adjustable dumbbell includes a handle, a shaft rotatably engaged through the handle, a carrier attached to each end portion of the shaft and having an inner housing and an outer housing and one or more middle housings spaced from each other for forming two or more gaps between the housings and for engaging with weight members, and the inner housing and the middle housing each include a spring-biased projection extendible into the gaps for selectively latching the weight members to the handle and the shaft and the carrier, and a control device is rotatably engaged onto the shaft and coupled to the handle for actuating the spring-biased projections to latch the selected weight members to the handle and the shaft and the carrier.

12 Claims, 11 Drawing Sheets

| | weight members (92+95) | weight members (91+94) | weight members (90+93) | |
|---|---|---|---|---|
| 1 | NO | NO | NO | 5 |
| 2 | NO | NO | YES | 7.5 |
| 3 | NO | YES | NO | 10 |
| 4 | YES | NO | NO | 15 |
| 5 | NO | YES | YES | 12.5 |
| 6 | YES | NO | YES | 17.5 |
| 7 | YES | YES | NO | 20 |
| 8 | YES | YES | YES | 22.5 |

FIG. 11

ADJUSTABLE DUMBBELL

BACKGROUND OF THE INVENTION

1. Field of the Invention

The present invention relates to an adjustable dumbbell, and more particularly to an adjustable dumbbell including an indicating structure or device for indicating the total weights of the weight members to be carried by the weight carrier or handle and for allowing the user to know how much weight he is carried or operated.

2. Description of the Prior Art

Typical adjustable dumbbells comprise a handle to be grasped or held by the user, and a number of weight plates to be selectively attached onto the ends of the handle for weight lifting or exercising purposes, or for exercising or training the upper muscle groups or the lower muscle groups of the user.

For example, U.S. Patent Application Publication No. US 2003/0114276 to Schiff, U.S. Pat. No. 7,137,931 to Liu, and U.S. Pat. No. 7,172,536 to Liu disclose several typical adjustable dumbbells each comprising two or more weight plates or weight members selectively or adjustably attaching or mounting onto the handle shaft or handle bar for being held or grasped by the users to train the upper muscle groups or the lower muscle groups of the user.

However, the total weights of the weight plates or weight members have not been shown; i.e., the user may not know how much weight he is carried or operated, and may have to check the other information in order to know how much weight he is carried or operated each time.

U.S. Patent Application Publication No. US 2004/0072661 to Krull, U.S. Pat. No. 6,669,606 to Krull, and U.S. Pat. No. 6,719,674 to Krull disclose the other typical adjustable dumbbells each also comprising two or more weight plates or weight members selectively or adjustably attaching or mounting onto the handle shaft or handle bar for being held or grasped by the users to train the upper muscle groups or the lower muscle groups of the user, and each further comprising a weight indicating structure or device for indicating the total weights of the weight members to be carried by the weight carrier or handle and for allowing the user to know how much weight he is carried or operated.

However, the housings or retainers for engaging with the weight plates or weight members should include or should be applied with a number of digits on the outer surface for showing or indicating the total weights of the weight members to be carried by the weight carrier or handle.

The present invention has arisen to mitigate and/or obviate the afore-described disadvantages of the conventional adjustable dumbbells.

SUMMARY OF THE INVENTION

The primary objective of the present invention is to provide an adjustable dumbbell including an indicating structure or device for indicating the total weights of the weight members to be carried by the weight carrier or handle and for allowing the user to know how much weight he is carried or operated.

In accordance with one aspect of the invention, there is provided an adjustable dumbbell comprising a number of weight members each including an opening formed therein, a handle including two end portions, and including a bore formed therein, a shaft rotatably engaged in the bore of the handle and including two end portions extended out of the handle, a carrier attached to each end portion of the shaft, and including an inner housing rotatably attached to the end portion of the shaft, and an outer housing and at least one middle housing attached to the inner housing and spaced from each other for forming at least two gaps between the inner housing and the outer housing and the middle housing and for selectively receiving and engaging with the weight members, and the inner housing and the middle housing each including a spring-biased projection extendible into the gaps that are formed between the inner housing and the outer housing and the middle housing for selectively engaging with the weight members and for latching the selected weight members to the handle and the shaft and the carrier, and a control device rotatably engaged onto the shaft and coupled to the handle for engaging with the spring-biased projections and for selectively actuating the spring-biased projections to engage with the weight members and to latch the selected weight members to the handle and the shaft and the carrier and for allowing the user to carry or operate the selected weight members of different weights.

The outer and the middle housing each include at least one protrusion extended therefrom for engaging with the middle housing and the inner housing and for spacing the inner housing and the outer housing and the middle housing from each other and for forming the gaps between the inner housing and the outer housing and the middle housing.

The outer and the middle housing each include a second protrusion extended therefrom for engaging with the middle housing and the inner housing and for spacing the inner housing and the outer housing and the middle housing from each other, and the second protrusion includes a width greater than that of the protrusion for fitted in the openings of the weight members and for suitably spacing the housings from each other.

The carrier includes two fasteners engaged through the protrusion and the second protrusions and engaged with the inner housing and the outer housing and the middle housing for securing the inner housing and the outer housing and the middle housing together.

The control device includes a base plate provided on each end portion of the handle and having a number pairs of recesses and bulges alternatively formed thereon for selectively engaging with the spring-biased projections.

The base plate includes two peripheral walls concentrically formed therein for forming a peripheral channel between the peripheral walls, and the pairs of recesses and bulges are formed and located in the peripheral channel that is formed between the peripheral walls.

The peripheral walls include an inner peripheral wall having an inner diameter greater than that of the bore of the handle for forming a peripheral shoulder in the handle and for receiving the control device.

The peripheral channel of the base plate is separated into two half circles each of which is divided into eight divisions, a first recess of the recesses is formed and located in first three divisions of each half circle, and a first bulge of the bulges is formed and located in a fourth division of each half circle, a second recess of the recesses is formed and located in a fifth division of each half circle, and a second bulge of the bulges is formed and located in last three divisions of each half circle.

The base plate includes a peripheral fence extended axially and outwardly therefrom and having an outer diameter smaller than that of the base plate for forming an outer peripheral shoulder therein, and includes a scale provided on the peripheral fence, the inner housing includes a peripheral flange extended radially and outwardly therefrom and having an outer diameter greater than that of the peripheral fence of the base plate and rotatably engaged onto the peripheral fence of the base plate and engaged with the peripheral shoulder of the handle for guiding and limiting the inner housing to rotate relative to the handle, and the inner housing includes a window formed in the peripheral flange for allowing the scale on the peripheral fence to be seen through the window of the inner housing.

The control device includes a barrel rotatably engaged onto the shaft and coupled to the handle, the barrel includes a number pairs of recesses and bulges alternatively formed thereon for selectively engaging with the spring-biased projections.

The handle includes at least one depression formed therein, and the barrel includes at least one key extended outwardly therefrom for engaging with the depression of the handle and for coupling the barrel to the handle and for allowing the barrel to be rotated in concert with the handle.

The barrel includes a peripheral channel formed therein and separated into two half circles each of which is divided into eight divisions, a first recess of the recesses is formed and located in first two divisions of each half circle, and a first bulge of the bulges is formed and located in a third division of each half circle, a second recess of the recesses is formed and located in a fourth division of each half circle, and a second bulge of the bulges is formed and located in a fifth division of each half circle, and a third recess of the recesses is formed and located in a sixth division of each half circle, and a third bulge of the bulges is formed and located in last two divisions of each half circle.

Further objectives and advantages of the present invention will become apparent from a careful reading of the detailed description provided hereinbelow, with appropriate reference to the accompanying drawings.

BRIEF DESCRIPTION OF THE DRAWINGS

FIG. 11 is a chart illustrating the arrangements or selections or operation of the adjustable dumbbell.

DETAILED DESCRIPTION OF THE PREFERRED EMBODIMENT

Figure 1:
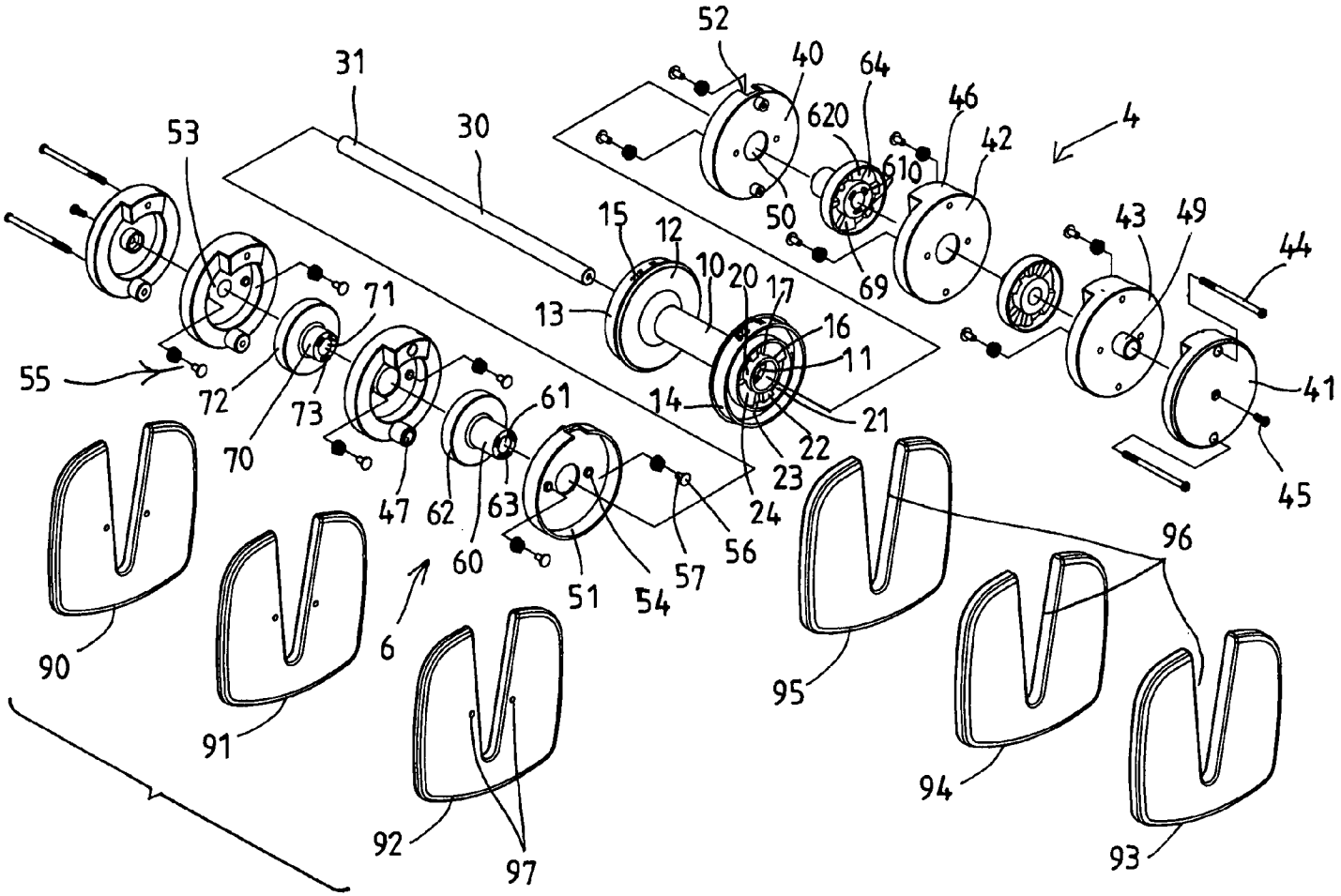
FIG. 1 is an exploded view of an adjustable dumbbell in accordance with the present invention.

Referring to the drawings, and initially to FIGS. 1-4, and 7-10, an adjustable dumbbell 1 in accordance with the present invention comprises a hand grip or handle 10 including a longitudinal bore 11 formed or provided therein, and including two anchors or end or base plates 12 extended radially and outwardly from the two side or end portions thereof respectively and each having an outer diameter greater than that of the handle 10, and including a peripheral fence 13 extended axially and outwardly from each of the base plates 12 and having an outer diameter slightly smaller than that of the base plates 12 for forming or defining an outer peripheral shoulder 14 therein, and including a mark or graduation or scale 15 formed or provided on each of the peripheral fences 13 for showing or indicating the total weights to be carried by the user, such as 5 (lb), 7.5 (lb), 10 (lb), 12.5 (lb), 15 (lb), 17.5 (lb), 20 (lb), 22.5 (lb).

A longitudinal shaft 30 is rotatably disposed or engaged into or through the bore 11 of the handle 10, and includes two end portions 31 extended or arranged or located out of the handle 10, best shown in FIGS. 7-10. An end member or carrier 4 is attached or secured to each of the end portions 31 of the shaft 30 and also attached or secured to each of the base plates 12 of the handle 10, and includes a first or inner housing 40 rotatably attached to each base plate 12, a second or outer housing 41 and one or more (such as two) intermediate or middle housings 42, 43 disposed or engaged onto the shaft 30 and secured together with one or more (such as two) beams or rods or bolts or fasteners 44, best shown in FIG. 7, and the outer housings 41 are mounted or secured to the end portions 31 of the shaft 30 with latches or fasteners 45 such that the housings 40-43 of the carriers 4 are solidly attached or secured onto the end portions 31 of the shaft 30 and rotated in concert with the shaft 30 relative to the handle 10.

Figure 3:
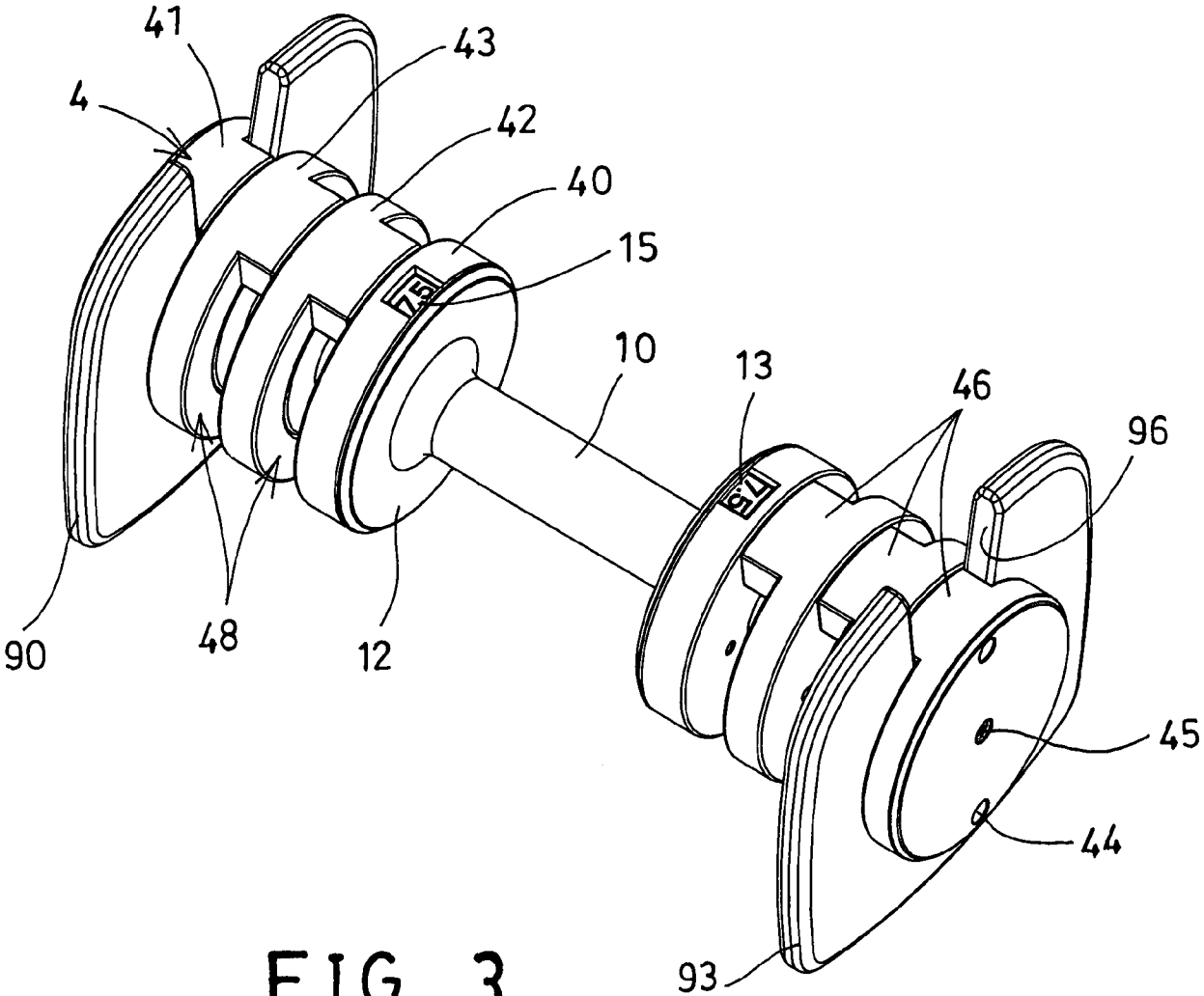
FIG. 3 is a perspective view similar to FIG. 2, illustrating the operation of the adjustable dumbbell.
Figure 4:
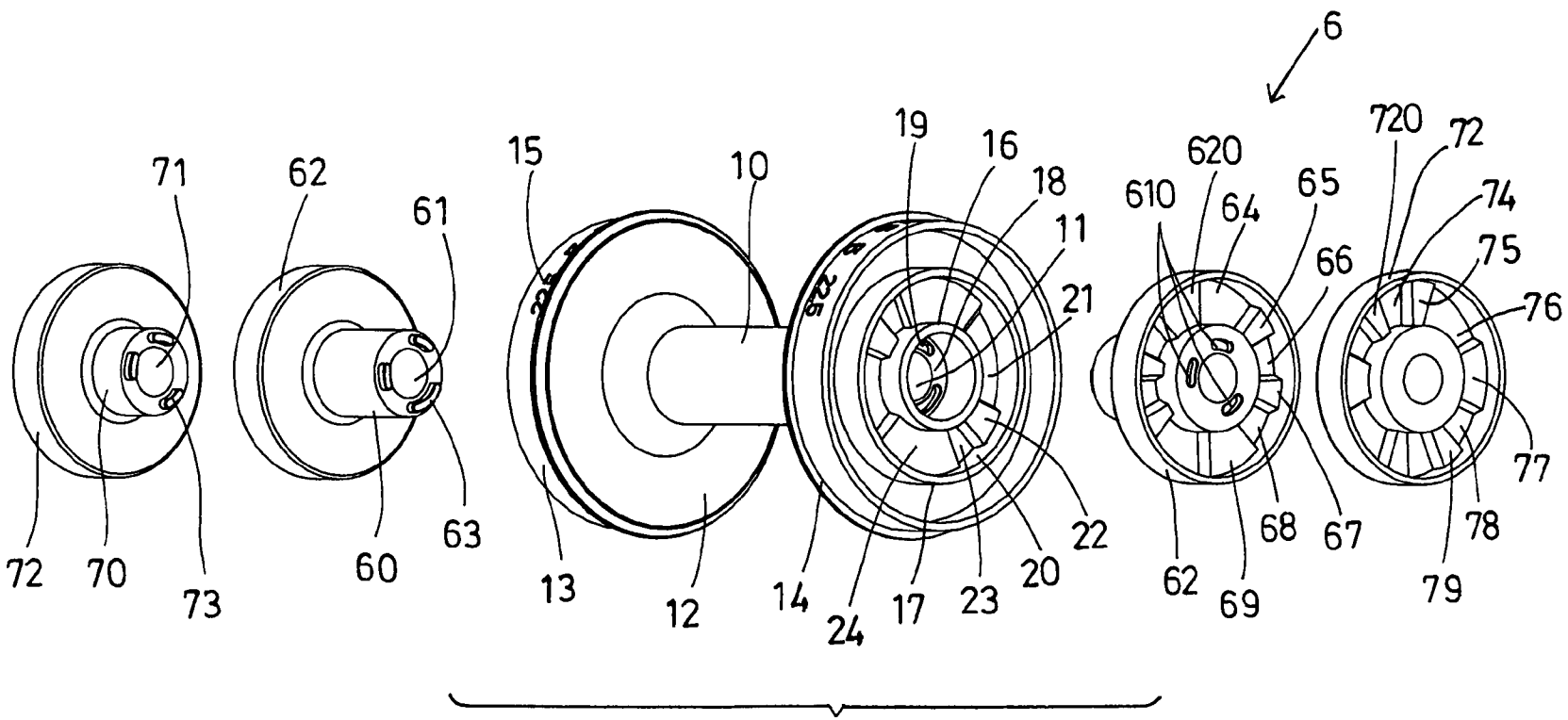
FIG. 4 is a partial exploded view of the adjustable dumbbell.
Figure 9:
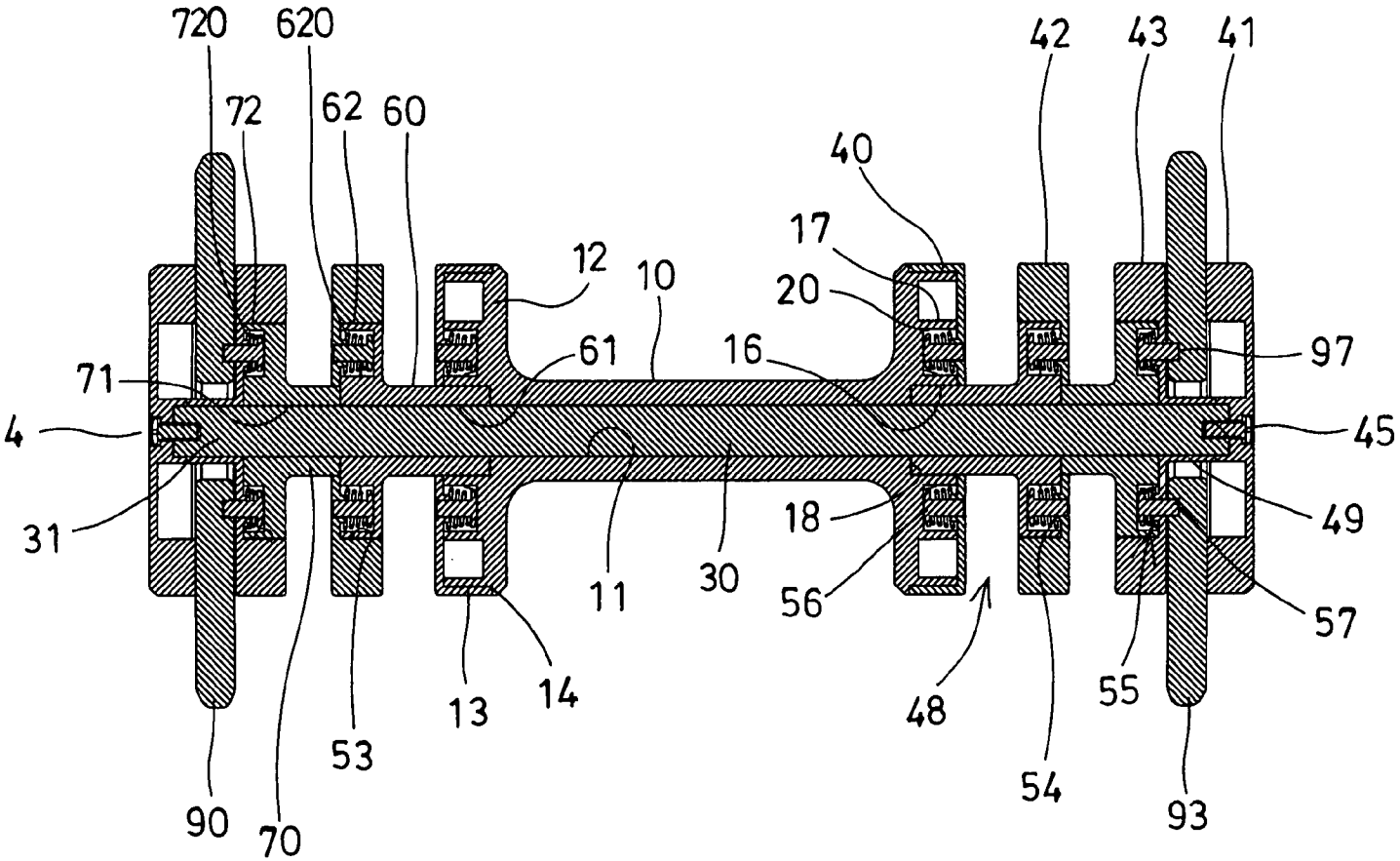
FIGS. 9, 10 are cross sectional views similar to FIG. 8, illustrating the operation of the adjustable dumbbell.

The outer and the middle housings 41-43 of the carriers 4 each include one or more (such as two) protrusions 46, 47 extended therefrom for engaging with the adjacent middle or inner housings 43, 42, 41 and for spacing the housings 41-43 from each other and for forming two or more (such as three) slots or gaps 48 between the housings 40-43, best shown in FIGS. 3 and 9, and for receiving or engaging with the weight plates or weight members 90, 91, 92, 93, 94, 95, in which the weight plates or weight members 90-95 may include different weights and each include an opening 96 formed therein, such as formed in the middle or central portion thereof and having a non-circular or substantially triangular or V-shaped cross section for slidably receiving or engaging with the protrusions 46, 47 and/or the fasteners 44 of the housings 41-43 and for allowing the weight members 90-95 to be selectively attached or mounted or engaged or anchored between the housings 40-43 and for preventing the weight members 90-95 from being rotated relative to the housings 40-43.

It is preferable that the protrusions 46 which are located above the other protrusions 47 include a dimension or width greater than that of the lower protrusions 47 for allowing the protrusions 46, 47 of the housings 41-43 to be snugly fitted or engaged in the V-shaped openings 96 of the weight members 90-95 and thus for stably retaining the weight members 90-95 between the housings 40-43 of the carriers 4. The beams or rods or fasteners 44 are engaged through the protrusions 46, 47 (FIG. 7) and threaded or engaged with the inner housing 40 for solidly securing the housings 40-43 together. One of the middle housings 43 which is located closer to the outer housing 41 includes a hub 49 extended outwardly from the center portion thereof (FIGS. 1 and 8-10) for engaging with the outer housing 41 and for suitably spacing the middle housing 43 and the outer housing 41 from each other and for snugly engaging onto the shaft 30.

As shown in FIG. 1, the inner housing 40 and the other middle housing 42 which is located closer to the inner housing 40 each include a bore 50 formed therein, in which the bores 50 of the housings 40, 42 includes an inner diameter greater than that of the shaft 30. The inner housings 40 each include a peripheral flange 51 extended radially and outwardly therefrom and having an outer diameter slightly greater than that of the peripheral fences 13 of the base plates 12 and pivotally or rotatably attached or mounted or engaged onto the peripheral fences 13 of the base plates 12 and engaged with the peripheral shoulder 14 of the handle 10 for guiding and limiting the inner housing 40 to rotate relative to the handle 10, and each include an opening or window 52 formed in the peripheral flange 51 for allowing the scale 15 to be seen through the window 52 of the inner housing 40.

As also shown in FIGS. 1 and 7-10, the middle housings 42, 43 each include a recess or compartment 53 formed therein and located in one side that faces or directs toward the inner housing 40. The inner housing 40 and the middle housings 42, 43 each include one or more (such as two) depressions or cavities 54 formed therein and oppositely located beside the center portion thereof, and a spring-biased projection 55 is disposed or received or engaged in each of the cavities 54 of the housings 40, 42, 43, and includes a smooth or rounded head 56 faced or directed toward the base plate 12 and the inner housing 40 and one of the middle housings 42, and includes a latch end 57 extendible out through the inner housing 40 and the middle housings 42, 43 respectively, and extendible into the slots or gaps 48 that are formed or provided between the housings 40-43, for selectively engaging with the engaging holes 97 of the weight members 90-95 and for selectively latching the selected number of weight members 90-95 to the handle 10 and the shaft 30 and the carriers 4.

As shown in FIGS. 1 and 4-10, an actuating or selecting or control device 6 is further provided and attached or mounted or engaged onto the shaft 30 and secured or mounted or coupled to the handle 10 and to be rotated in concert with the handle 10, and includes one member or a portion formed or provided on the base plates 12 of the handle 10, for example, the base plates 12 of the handle 10 each include an inner or first peripheral wall 16 and a middle or second peripheral wall 17 concentrically formed or provided or extended therefrom and located within the peripheral fence 13, and also concentric with the peripheral fence 13, in which the first or inner peripheral wall 16 includes an inner or outer diameter greater than that of the bore 11 of the handle 10 for forming or defining a peripheral shoulder 18 between the bore 11 and the inner peripheral wall 16 of the handle 10, and the handle 10 includes one or more (such as three) depressions 19 formed therein and communicative with the peripheral shoulder 18 of the handle 10.

The handle 10 further includes an annular or peripheral channel 20 formed or provided and located between the inner and the outer peripheral walls 16, 17 of the handle 10, and separated or divided into two halves or two half circles each of which is further divided into eight areas or segments or divisions each having about 22.5 degrees (FIGS. 5, 6), a recess 21 is formed and provided or located in the first three divisions of each half circle, and the recesses 21 of the two half circles are opposite to each other, a relative bulge 22 is formed and provided or located in the fourth division of each half circle, another recess 23 is formed and provided or located in the fifth division of each half circle, and another bulge 24 is formed and provided or located in the last three divisions of each half circle, again, the recesses 21, 23 and the bulges 22, 24 of the two half circles are alternatively formed on the base plate 12 and are opposite to each other, in which the recesses 21, 23 and the bulges 22, 24 of the handle 10 form or act as a portion of the control device 6 and provided for being engaged with the spring-biased projections 55 of the inner housing 40.

The control device 6 further includes two barrels 60, 70 each having a bore 61, 71 formed therein for receiving or engaging with the shaft 30, in which one of the barrels or the inner barrel 60 is disposed or located or engaged between the inner housing 40 and the one middle housing 42, and includes an enlarged head 62 pivotally or rotatably engaged in the compartment 53 of the middle housing 42, and includes one or more (such as three) keys 63 extended outwardly therefrom for engaging with the depressions 19 of the handle 10 and for attaching or mounting or securing or coupling the barrel 60 to the handle 10 and for allowing the barrel 60 to be rotated in concert with the handle 10, the other barrel or the outer barrel 70 is disposed or located or engaged between the two middle housings 42, 43, and also includes an enlarged head 72 pivotally or rotatably engaged in the compartment 53 of the other middle housing 43.

The barrel 60 includes one or more (such as three) depressions 610 formed therein (FIGS. 1, 4-6) and faced or directed toward the other barrel 70, and the other barrel 70 also includes one or more (such as three) keys 73 extended outwardly therefrom for engaging with the depressions 610 of the barrel 60 and for attaching or mounting or securing or coupling the barrels 60, 70 together and for allowing the barrels 60, 70 to be rotated in concert with the handle 10. The barrel 60 also includes one side or annular or peripheral channel 620 formed therein and facing or directing toward the middle housing 42 for engaging with the spring-biased projections 55 of the middle housing 42, and the other barrel 70 also includes one side or annular or peripheral channel 720 formed therein and facing or directing toward the other middle housing 43 for engaging with the spring-biased projections 55 of the other middle housing 43.

The annular or peripheral channel 620 of the barrel 60 is also separated or divided into two halves or two half circles each of which is further divided into eight areas or segments or divisions (FIGS. 5, 6), a recess 64 is formed and provided or located in the first two divisions of each half circle, a relative bulge 65 is formed and provided or located in the third division of each half circle, another recess 66 is formed and provided or located in the fourth division of each half circle, and another bulge 67 is formed and provided or located in the fifth division of each half circle, and a further recess 68 is formed and provided or located in the sixth division of each half circle, and a further bulge 69 is formed and provided or located in the last two divisions of each half circle, again, the recesses 64, 66, 68 and the bulges 65, 67, 69 of the two half circles are opposite to each other, in which the recesses 64, 66, 68 and the bulges 65, 67, 69 of the barrel 60 also form or act as a portion of the control device 6 and provided for being engaged with and for actuating the spring-biased projections 55 of the middle housing 42.

The annular or peripheral channel 720 of the other barrel 70 is also separated or divided into two halves or two half circles each of which is further divided into eight areas or segments or divisions, a recess 74 is formed and provided or located in the first division of each half circle, a relative bulge 75 is formed and provided or located in the second division of each half circle, another recess 76 is formed and provided or located in the third and the fourth divisions of each half circle, and another bulge 77 is formed and provided or located in the fifth and the sixth divisions of each half circle, and a further recess 78 is formed and provided or located in the seventh division of each half circle, and a further bulge 79 is formed and provided or located in the last or eighth division of each half circle, again, the recesses 74, 76, 78 and the bulges 75, 77, 79 of the two half circles are opposite to each other, in which the recesses 74, 76, 78 and the bulges 75, 77, 79 of the barrel 70 also form or act as a portion of the control device 6 and provided for being engaged with the spring-biased projections 55 of the middle housing 43 and for actuating the spring-biased projections 55 to selectively engage with the weight members 90-95.

It is to be noted that the housings 40-43 of the carriers 4 are solidly attached or secured onto the end portions 31 of the shaft 30 and rotated in concert with the shaft 30 relative to the handle 10, and the carriers 4 each include two or more (such as three) slots or gaps 48 formed between the housings 40-43 for receiving or engaging with the weight plates or weight members 90-95, and the inner housing 40 and the middle housings 42, 43 each include one or more (such as two) spring-biased projections 55 each having a latch end 57 extendible out through the housings 40, 42, 43 respectively, and extendible into the slots or gaps 48 that are formed or provided between the housings 40-43, for selectively engaging with the engaging holes 97 of the weight members 90-95 and for latching the selected weight members 90-95 to the handle 10 and the shaft 30 and the carriers 4. The barrels 60, 70 of the control device 6 are attached or mounted or engaged onto the end portion 31 of the shaft 30 and coupled to the handle 10 and rotated in concert with the handle 10 and rotatable relative to the shaft 30 and the housings 40-43 by the handle 10 in order to actuate the spring-biased projections 55 to selectively engage with the engaging holes 97 of the weight members 90-95 and to selectively latch the selected number of weight members 90-95 to the handle 10 and the shaft 30 and the carriers 4.

Figure 2:
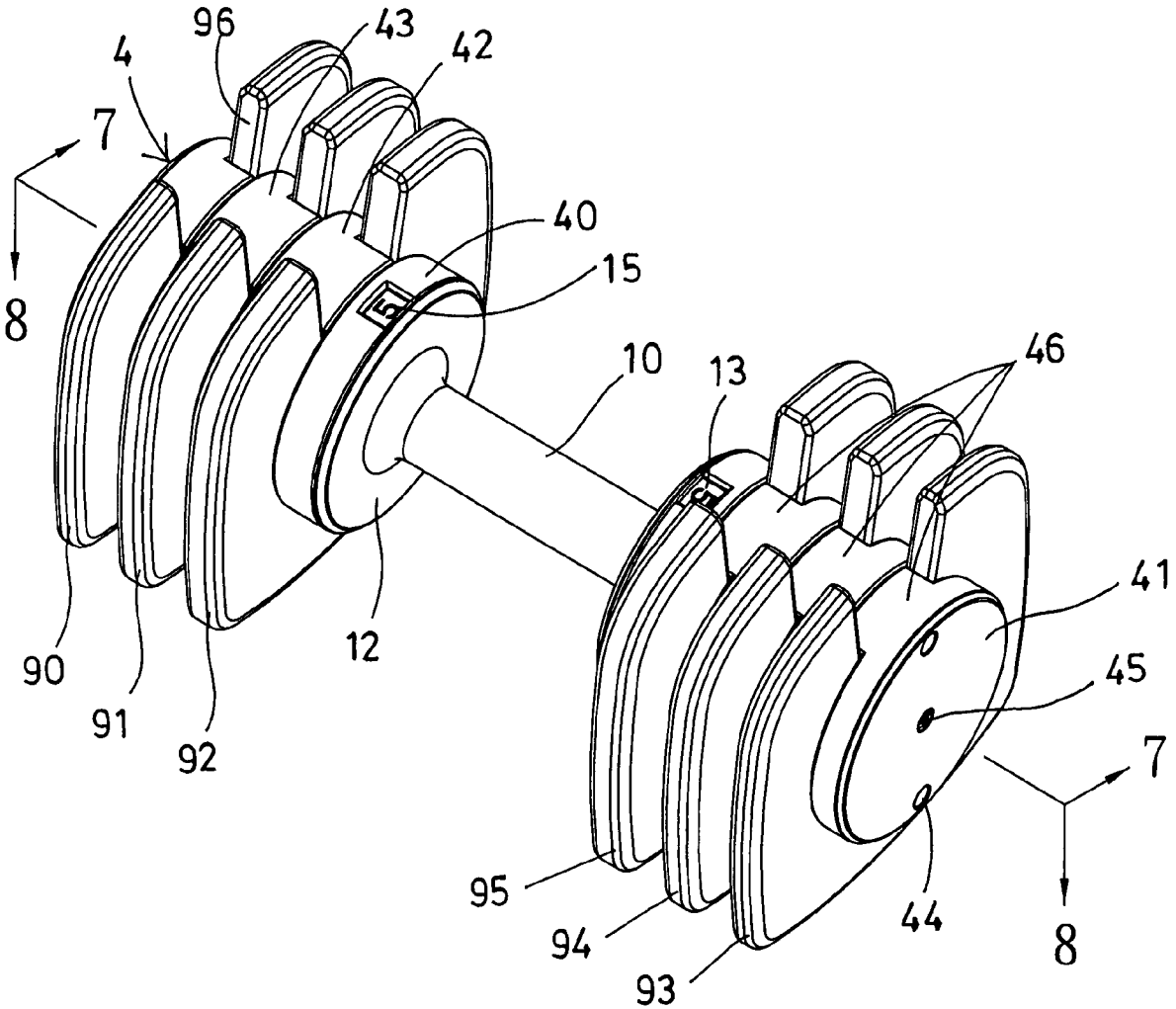
FIG. 2 is a perspective view of the adjustable dumbbell.
Figure 7:
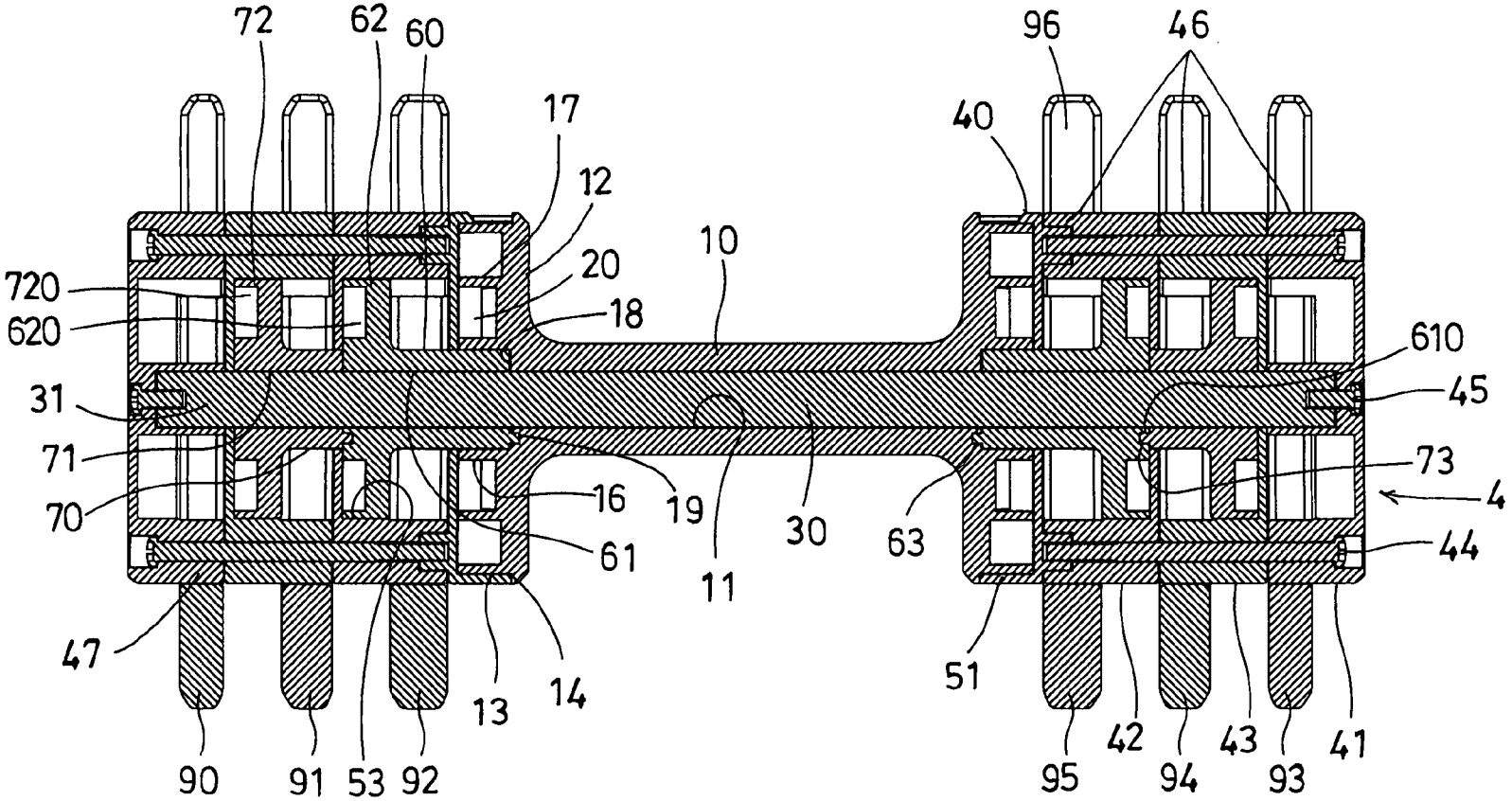
FIGS. 7, 8 are cross sectional views of the adjustable dumbbell taken along lines 7-7 and 8-8 of FIG. 2 respectively.
Figure 8:
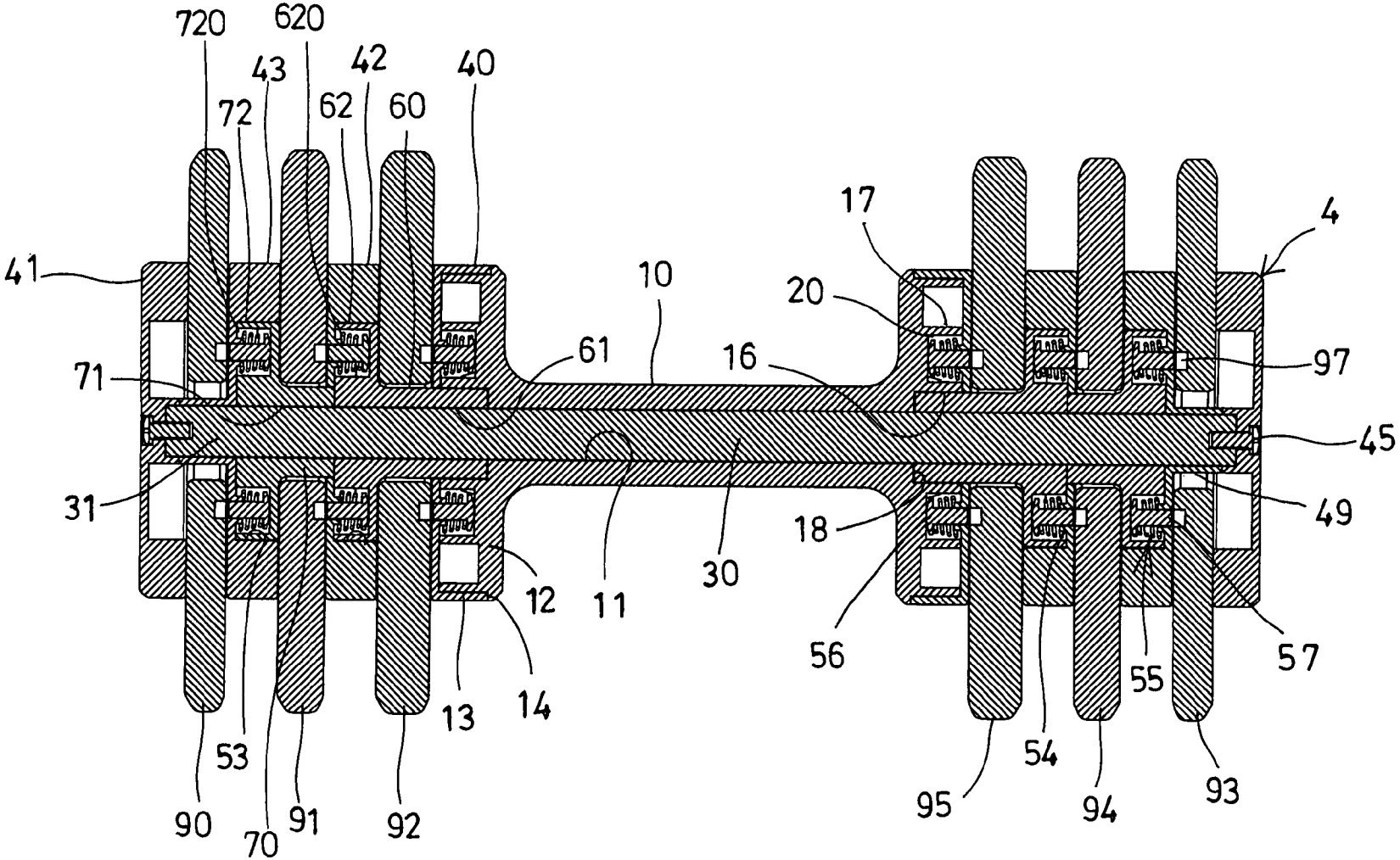

In operation, as shown in FIGS. 2 and 7-8, when the handle 10 is not rotated relative to the shaft 30 and the housings 40-43, the control device 6 may not actuate the spring-biased projections 55 to engage with the weight members 90-95 and may not latch the weight members 90-95 to the handle 10 and the shaft 30 and the carriers 4 at this moment, and only the handle 10 and the carriers 4 may be lifted or moved away from the weight members 90-95 and may be moved or exercised by the user without the weight members 90-95. The total weight of the handle 10 and the shaft 30 and the carriers 4 and the control device 6 may be arranged as 5 lbs, for example.

Figure 5:
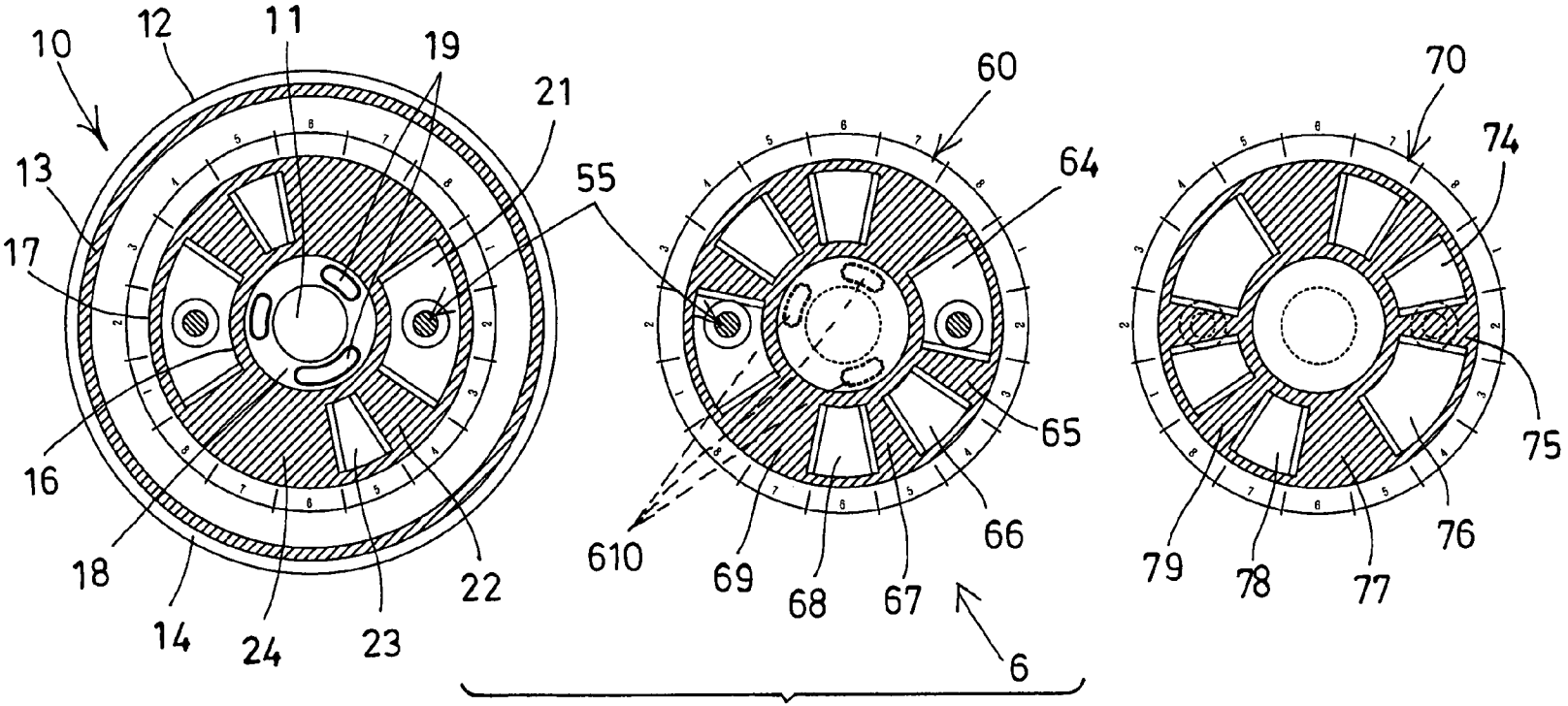
FIG. 5 is a partial plan and exploded view of the adjustable dumbbell.
Figure 6:
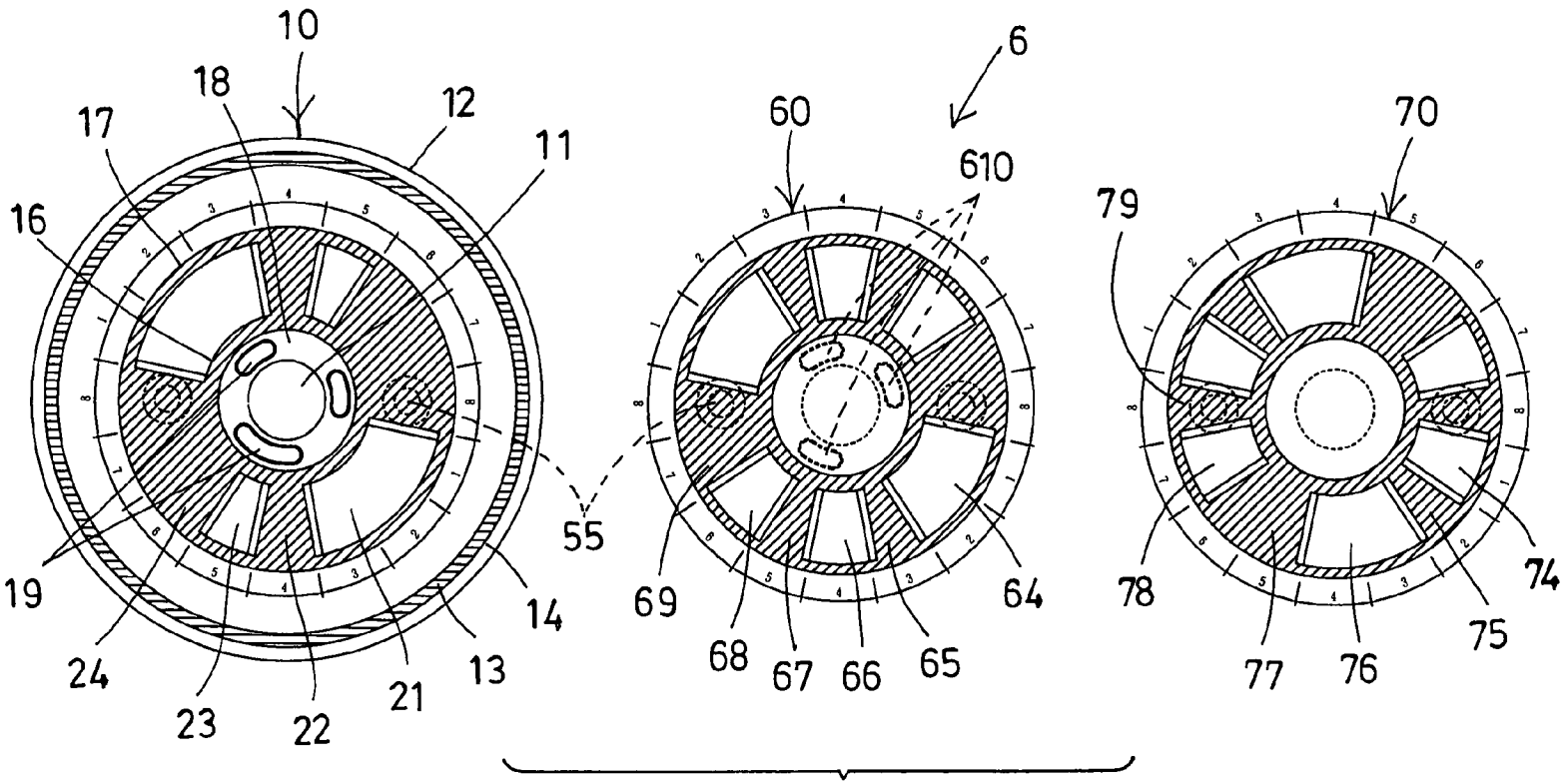
FIG. 6 is another partial plan and exploded view similar to FIG. 5, illustrating the operation of the adjustable dumbbell.
Figure 10:
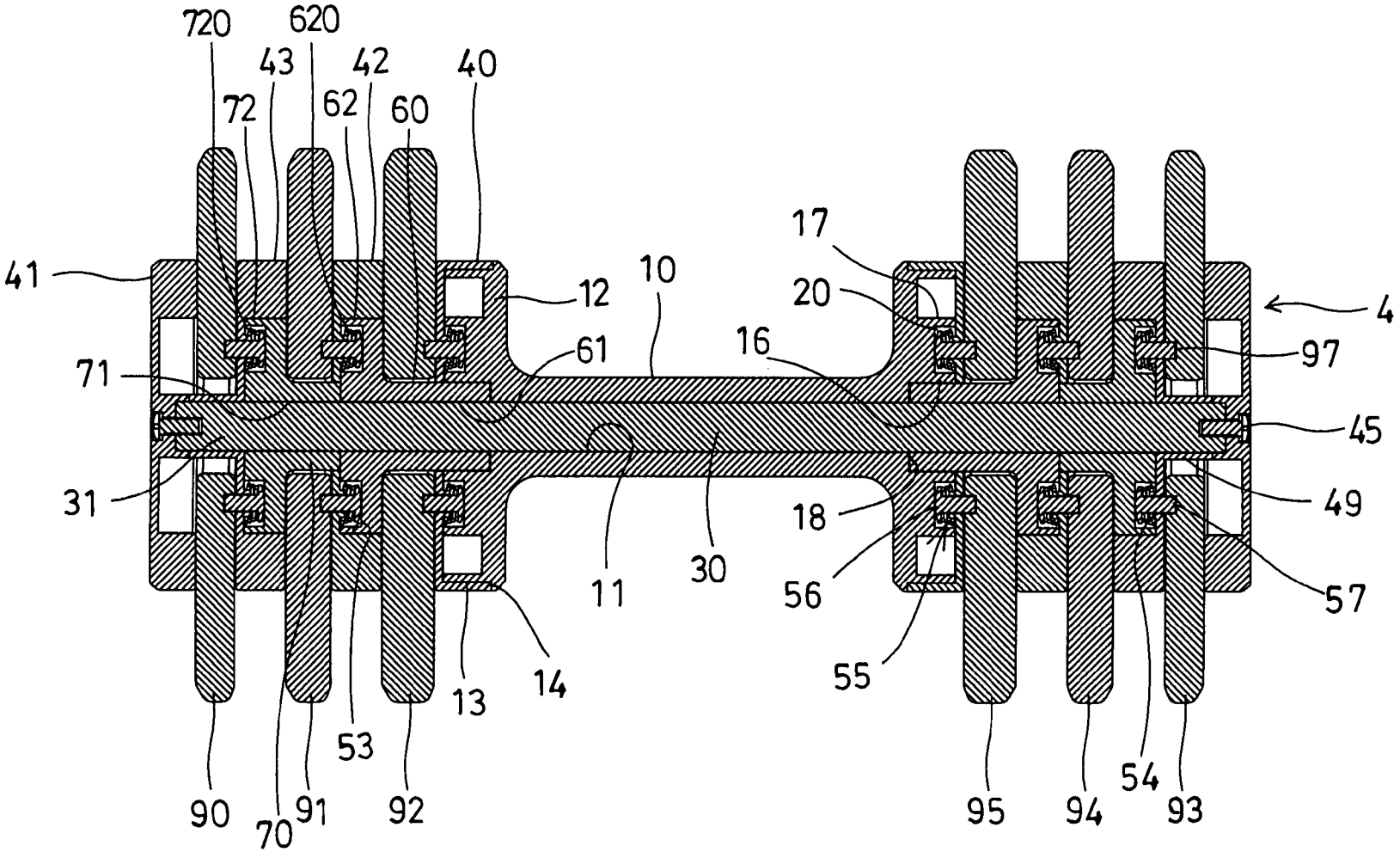

As shown in FIGS. 3, 5 and 9, when the handle 10 is rotated relative to the shaft 30 and the housings 40-43 for about 22.5 degrees, the bulges 75 of the outer barrels 70 may be rotated to engage with the spring-biased projections 55 of the middle housing 43 and to actuate the spring-biased projections 55 of the middle housing 43 to selectively engage with the engaging holes 97 of the weight members 90, 93 and to latch the selected weight members 90, 93 to the handle 10 and the shaft 30 and the carriers 4. As shown in FIGS. 6 and 10, when the handle 10 is rotated relative to the shaft 30 and the housings 40-43 for one hundred and eighty (180) degrees, the bulges 24, 69, 79 of the base plates 12 and the barrels 60, 70 of the control device 6 are rotated or caused to engage with the spring-biased projections 55 of the housings 40, 42, 43 and to actuate the spring-biased projections 55 of the housings 40, 42, 43 to selectively engage with the weight members 90-95 and to latch the selected weight members 90-95 to the handle 10 and the shaft 30 and the carriers 4.

As shown in FIG. 11, the weight members 90-95 may thus be selectively or changeably attached or mounted or secured or coupled to the handle 10 and the shaft 30 and the carriers 4 in different weights, such as 5 lbs., 7.5 lbs., 10 lbs., 12.5 lbs., 15 lbs., 17.5 lbs., 20 lbs., and 22.5 lbs., and the graduation or scale 15 that is formed or provided on the peripheral fences 13 may be seen through the window 52 of the inner housing 40. It is to be noted that the selected or the required number of the weight members 90-95 may be easily and quickly and selectively or changeably engaged onto the carriers 4 and the handle 10, and may be easily and quickly locked or secured to the carriers 4 and the handle 10 with the spring-biased projections 55 of the housings 40, 42, 43, such that the weight members 90-95 may be changeably and easily and quickly mounted or attached to the carriers 4 and the handle 10. The weight members 90-95 may thus be easily and quickly engaged onto the carriers 4 or disengaged from the carriers 4 by pivoting or rotating the handle 10 and the barrels 60, 70 of the control device 6 relative to the carriers 4 and the shaft 30.

Accordingly, the adjustable barbell or dumbbell or exercise device in accordance with the present invention includes an indicating structure or device for indicating the total weights of the weight members to be carried by the weight carrier or handle and for allowing the user to know how much weight he is carried or operated.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An adjustable dumbbell comprising:

a plurality of weight members each including an opening formed therein, a handle including two end portions, and including a bore formed therein, a shaft rotatably engaged in said bore of said handle and including two end portions extended out of said handle, a carrier attached to each end portion of said shaft, and including an inner housing attached to said end portion of said shaft and rotated in concert with said shaft, and an outer housing and at least one middle housing attached to said inner housing and spaced from each other for forming at least two gaps between said inner housing and said outer housing and said at least one middle housing and for selectively receiving and engaging with said weight members, and said inner housing and said at least one middle housing each including a spring-biased projection extendible into said gaps that are formed between said inner housing and said outer housing and said at least one middle housing for selectively engaging with said weight members and for latching the selected weight members to said handle and said shaft and said carrier, and a control device rotatably engaged onto said shaft and coupled to said handle for engaging with said spring-biased projections and for selectively actuating said spring-biased projections to engage with said weight members and to latch the selected weight members to said handle and said shaft and said carrier.

2. The adjustable dumbbell as claimed in claim 1, wherein said outer and said at least one middle housing each include at least one protrusion extended therefrom for engaging with said at least one middle housing and said inner housing and for spacing said inner housing and said outer housing and said at least one middle housing from each other and for forming said gaps between said inner housing and said outer housing and said at least one middle housing.

3. The adjustable dumbbell as claimed in claim 2, wherein said outer and said at least one middle housing each include a second protrusion extended therefrom for engaging with said at least one middle housing and said inner housing and for spacing said inner housing and said outer housing and said at least one middle housing from each other, and said second protrusion includes a width greater than that of said at least one protrusion for fitted in said openings of said weight members.

4. The adjustable dumbbell as claimed in claim 3, wherein said carrier includes two fasteners engaged through said at least one protrusion and said second protrusions and engaged with said inner housing and said outer housing and said at least one middle housing for securing said inner housing and said outer housing and said at least one middle housing together.

5. The adjustable dumbbell as claimed in claim 1, wherein said control device includes a base plate provided on each end portion of said handle and having a plurality of pairs of recesses and bulges alternatively formed thereon for selectively engaging with said spring-biased projections.

6. The adjustable dumbbell as claimed in claim 5, wherein said base plate includes two peripheral walls concentrically formed therein for forming a peripheral channel between said peripheral walls, and said pairs of recesses and bulges are formed and located in said peripheral channel that is formed between said peripheral walls.

7. The adjustable dumbbell as claimed in claim 6, wherein said peripheral walls include an inner peripheral wall having an inner diameter greater than that of said bore of said handle for forming a peripheral shoulder in said handle.

8. The adjustable dumbbell as claimed in claim 6, wherein said peripheral channel of said base plate is separated into two half circles each of which is divided into eight divisions, a first recess of said recesses is formed and located in first three divisions of each half circle, and a first bulge of said bulges is formed and located in a fourth division of each half circle, a second recess of said recesses is formed and located in a fifth division of each half circle, and a second bulge of said bulges is formed and located in last three divisions of each half circle.

9. The adjustable dumbbell as claimed in claim 5, wherein said base plate includes a peripheral fence extended axially and outwardly therefrom and having an outer diameter smaller than that of said base plate for forming an outer peripheral shoulder therein, and includes a scale provided on said peripheral fence, said inner housing includes a peripheral flange extended radially and outwardly therefrom and having an outer diameter greater than that of said peripheral fence of said base plate and rotatably engaged onto said peripheral fence of said base plate and engaged with said peripheral shoulder of said handle for guiding and limiting said inner housing to rotate relative to said handle, and said inner housing includes a window formed in said peripheral flange for allowing said scale to be seen through said window of said inner housing.

10. The adjustable dumbbell as claimed in claim 1, wherein said control device includes a barrel rotatably engaged onto said shaft and coupled to said handle, said barrel includes a plurality of pairs of recesses and bulges alternatively formed thereon for selectively engaging with said spring-biased projections.

11. The adjustable dumbbell as claimed in claim 10, wherein said handle includes at least one depression formed therein, and said barrel includes at least one key extended outwardly therefrom for engaging with said at least one depression of said handle and for coupling said barrel to said handle and for allowing said barrel to be rotated in concert with said handle.

12. The adjustable dumbbell as claimed in claim 10, wherein said barrel includes a peripheral channel formed therein and separated into two half circles each of which is divided into eight divisions, a first recess of said recesses is formed and located in first two divisions of each half circle, and a first bulge of said bulges is formed and located in a third division of each half circle, a second recess of said recesses is formed and located in a fourth division of each half circle, and a second bulge of said bulges is formed and located in a fifth division of each half circle, and a third recess of said recesses is formed and located in a sixth division of each half circle, and a third bulge of said bulges is formed and located in last two divisions of each half circle.

* * * * *